US005423266A

United States Patent [19]

Adams

[11] Patent Number: 5,423,266

[45] Date of Patent: Jun. 13, 1995

[54] LAND MINE

[76] Inventor: Keith R. Adams, HHB S/8 FAR, Fort Bragg, N.C. 28307

[21] Appl. No.: 292,253

[22] Filed: Aug. 18, 1994

[51] Int. Cl.[6] ..... F42B 23/00

[52] U.S. Cl. ..... 102/401

[58] Field of Search ..... 102/364, 367, 370, 401, 102/426, 428

[56] References Cited

U.S. PATENT DOCUMENTS

| | | | |
|---|---|---|---|
| H464 | 5/1988 | Lee et al. | 102/364 |
| 2,502 | 3/1842 | MacGregor, Jr. . | |
| 952,478 | 3/1910 | Strotzka et al. . | |
| 2,306,941 | 12/1942 | Fontaine . | |
| 2,351,474 | 6/1944 | Berger | 102/428 |
| 2,438,307 | 3/1948 | Taylor et al. | 102/428 |
| 2,514,401 | 7/1950 | Liljegren . | |
| 2,555,318 | 6/1951 | Christensen . | |
| 2,970,544 | 2/1961 | Malm | 102/401 |
| 3,216,354 | 11/1965 | Bearce . | |
| 3,447,461 | 6/1969 | LaPof . | |
| 3,575,110 | 4/1971 | Conroy . | |
| 3,717,094 | 2/1973 | Morrow . | |
| 3,844,215 | 10/1974 | Rogers, Jr. et al. . | |
| 3,951,066 | 4/1976 | Schroeder | 102/364 |
| 4,143,598 | 3/1979 | Marer | 102/428 |

*Primary Examiner*—Charles T. Jordan
*Assistant Examiner*—Theresa M. Wesson
*Attorney, Agent, or Firm*—John G. Mills Associates

[57] ABSTRACT

This invention is a relatively simple and yet highly efficient disabling mine that is approximately the size of a tube of lip balm or a 20 gauge shotgun shell. A detonator and its associated detonator pin is adapted to fire a detonator cap in the end of a charge chamber. The charge chamber is filled with magnesium except for the area immediately adjacent the detonator cap which is gunpowder that is used as a magnesium igniter. When the mine of the present invention is ignited, it will burn fiercely at a temperature in excess of 3000 Fahrenheit for a period of 5 to 6 seconds which will disable personnel as well as vehicles and other enemy equipment coming in contact therewith. Because of the relatively small size of the mines of the present invention, at least 50 of the same can be carried by a single soldier in a bandolier.

2 Claims, 1 Drawing Sheet

LAND MINE

FIELD OF INVENTION

This invention relates to weapons of war and more particularly to land mines.

BACKGROUND OF INVENTION

Since the development of gun powder and means for detonating the same, military ordinance developers have applied technology to land mine devices.

Various shapes and forms of these mines have been developed over the years and have included relatively simple electrical detonating means to relatively complex fuse and firing systems.

In addition to the above, many of the prior art mines have been relatively large and bulky, are difficult to carry, particularly in large numbers, and are ineffective in operation.

Concise Explanation of References

U.S. Pat. No. 2,351,474 to Berger is considered of interest in that it discloses a plurality of land mines that are deployed in a predetermined pattern and are detonated by telescoping sleeves with a spring loaded pin.

U.S. Pat. No. 3,575,110 to Conroy discloses a nonmetallic antipersonnel mine with a relatively complex detonating system that has to be charged prior to use.

U.S. Pat. No. 2,306,941 to Fontaine discloses a rather complex firing device for land mines including at least two spring biased portions.

The remaining U.S. Pat. Nos. 3,447,461 to LaPof, 3,216,354 to Bearce, 2,514,401 to Liljegren, 4,143,598 to Marer, 3,717,094 to Morrow, 2,555,318 to Christensen, 3,844,215 to Rogers, Jr. et al, 952,478 to Strotzka et al, and 2502 to MacGregor, Jr. are all considered of general interest only in that they disclose additional land mine devices but are otherwise not pertinent to the present invention.

BRIEF DESCRIPTION OF INVENTION

After much research and study into the complexities and disadvantages of the above-mentioned references, the present invention has been developed to provide a relatively simple and yet highly-efficient disabling mine that is relatively small in size and yet highly-efficient in use.

The mine of the present invention is approximately the same size as a tube of lip balm or a 20 gauge shotgun shell and is preferably made from plastic except for the detonator pin and detonator cap.

The main charge of the mine of the present invention is magnesium which burns extremely fast and hot. This is ignited by an ignition powder such as gun powder that is detonated by a detonator cap.

Fifty or more mines of the present invention can be carried in a bandolier prior to being armed and placed strategically in the path of enemy troops and/or equipment.

In view of the above, it is an object of the present invention to provide a relatively simple, lightweight land-type mine.

Another object of the present invention is to provide a disabling mine that, once detonated, will burn extremely fast and extremely hot.

Another object of the present invention is to provide a land mine that is safe with the Same only being armed when the detonator is placed in an operative position.

Another object of the present invention is to provide a rapid burn land mine that is highly efficient in operation and yet is relatively small in size.

Another object of the present invention is to provide a land mine that, when detonated, will burn fiercely at a temperature of over 3,000° Fahrenheit.

Another object of the present invention is to provide a land mine that is so sized that at least fifty of the same can be carried in a bandolier.

Other objects and advantages of the present invention will become apparent and obvious from a study of the following description and the accompanying drawings which are merely illustrative of such invention.

DETAILED DESCRIPTION OF INVENTION

Figure 1:
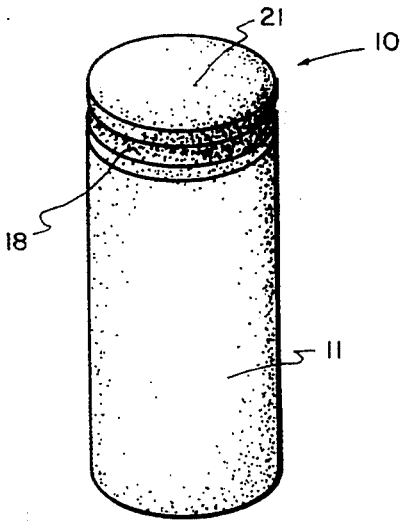
FIG. 1 is a perspective view of the land mine of the present invention.
Figure 2:
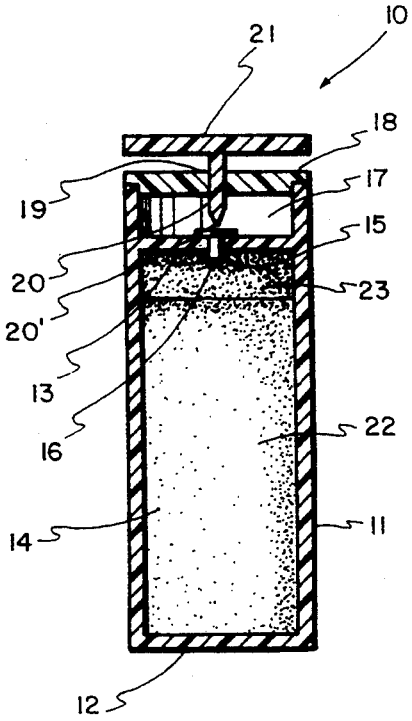
FIG. 2 is a sectional view taken through lines 2—2 of FIG. 1.
Figure 3:
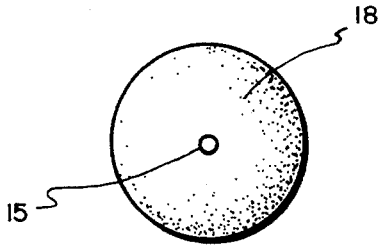
FIG. 3 is a top plan view of the mine of the present invention prior to installation of the detonator.
Figure 4:
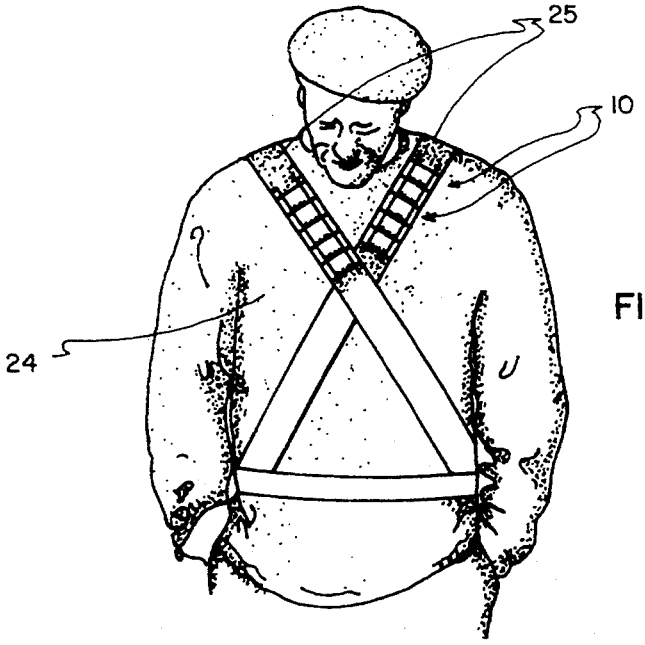
FIG. 4 is a view of a soldier wearing a bandolier holding the mines of the present invention.

With further reference to the drawings, the land mine of the present invention, indicated generally at 10, is preferably formed from plastic or a similar material and includes cylindrical side wall 11 with a bottom 12 enclosing one end thereof. An intermediate wall 13 is formed interiorally of and adjacent to the opposite end of the side wall 11 from bottom 12 as can clearly be seen in FIG. 2.

The space between bottom 12 and intermediate wall 13 inside side wall 11 defines charge chamber 14. There is a central opening 15 in intermediate wall 13 that is designed to retainingly receive detonator cap 16. Since detonator caps and their operation are well known to those skilled in the art, further detailed discussion of this portion of the present invention is not deemed necessary.

The recess between intermediate wall 13 and the upper end of side wall 11, as oriented in the drawings, forms a detonator well 17. A top 18 is mounted on the end of side wall 11 opposite bottom 12 as can clearly be seen in FIG. 2. A central opening 19 is provided in top 18 through which the detonator pin 20 of the detonator 21 is adapted to pass with the tip 20' of such pin being disposed adjacent the detonator cap 16.

The charge chamber 14 is filled to within a quarter of an inch of intermediate wall 13 with an element such as magnesium 22 that will burn fiercely when ignited. The space between the magnesium 22 and intermediate wall 13 in which the detonator cap 16 is mounted, is filled with an ignition powder 23. Since the composition of ignition powders is well known to those skilled in the art, further detailed discussion of this portion of the present invention is not deemed necessary.

Even though the detonator pin and detonator cap have been indicated as being metal, the entire detonator including the pin could be formed from hard plastic as well as the detonator cap. This would prevent metal detectors from being used to locate the deployed mines.

The soldier or other person 24 who is deploying the mines 10 of the present invention can carry such mines in any convenient manner such as on a bandolier 25 draped across the shoulders of such soldier. The detonator 21 with its associated detonator pin 20 would be kept separate from the mine 10 until it is desired to arm such mine. The detonator pin can then be passed through the central opening 19 of top 18 to the position shown in sectional FIG. 2.

The overall size of the land mine of the present invention is preferably ½ inch to ¾ inch in diameter and between 2½ inches and 3 inches in length or approximately the same size as a tube of lip balm or a twenty gauge shot gun shell.

Once a mine has been armed as described above, anything that presses down on the detonator 21 will cause the detonator pin 20 to strike the detonator cap 16 which ignites the ignition powder 23 in the upper portion of charge chamber 14. This will in turn ignite the magnesium 22 in such chamber which will burn fiercely at a temperature over 3,000° Fahrenheit. This rapid burn will last between five and six seconds which is more than enough time to disable the enemy personnel, vehicles and the like striking the mine.

From the above it can be seen that the present invention provides an extremely simple, inexpensive and yet highly-efficient land mine for disabling enemy personnel, vehicles and any other equipment that comes in contact therewith. This invention is much more effective than explosives which would be relatively ineffective because of the small size of the present invention.

The terms "top", "bottom", "side", etc. have been used herein merely for convenience to describe the present invention and its parts as oriented in the drawings. It is to be understood, however, that these terms are in no way limiting to the invention since the same may obviously be disposed in different orientations when in use.

The present invention may, of course, be carried out in other specific ways that those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A portable land mine comprising: a plastic cylindrical side wall with a bottom enclosing one end thereof and an intermediate wall with a central opening therein; formed interiorly of and adjacent to the opposite end of said side wall to define a charge chamber; a plastic detonator cap mounted in the central opening in the intermediate wall; ignition powder disposed within the charge chamber adjacent the intermediate wall and its detonator cap; magnesium disposed between and filling the area in the charge chamber between the ignition powder and the bottom; a plastic top mounted on the end of the cylindrical side wall opposite the bottom, said top having an opening therein above and in alignment with the detonator cap; and a separate plastic detonator with a detonator pin outwardly extending therefrom with a pointed tip at the outer end thereof whereby a portable land mine is provided that cannot be detonated when the detonator is kept separate therefrom and which can be readily armed by passing the detonator pin through the opening in the top with the tip of the detonator pin in alignment with the detonator cap.

2. The land mine of claim 1 wherein the cylindrical side wall is between ½ and ¾ of an inch in diameter and between 2½ and 3 inches in length.

* * * * *